US006711819B2

(12) United States Patent
Stall et al.

(10) Patent No.: US 6,711,819 B2
(45) Date of Patent: Mar. 30, 2004

(54) SCANDIUM CONTAINING ALUMINUM ALLOY FIREARM

(75) Inventors: Thomas C. Stall, North Grosvenordale, CT (US); Jeffrey Luty, Longmeadow, MA (US); Kevin R. Fleury, Feeding Hills, MA (US); Norman W. Spencer, Longmeadow, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 10/397,644

(22) Filed: Mar. 26, 2003

(65) Prior Publication Data

US 2004/0010917 A1 Jan. 22, 2004

Related U.S. Application Data

(62) Division of application No. 09/859,983, filed on May 17, 2001, now Pat. No. 6,557,289.

(60) Provisional application No. 60/205,270, filed on May 18, 2000.

(51) Int. Cl.[7] ..... B21D 51/20

(52) U.S. Cl. ..... 29/898.14; 29/903; 42/71.02; 42/76.02

(58) Field of Search ..... 29/898.14, 903, 29/DIG. 2, DIG. 25; 42/76.02, 71.02, 71.01; 89/16

(56) References Cited

U.S. PATENT DOCUMENTS 3,619,181 A * 11/1971 Wiley
3,984,260 A * 10/1976 Watts et al. ..... 29/527.7
4,261,742 A 4/1981 Coupland et al.
4,261,767 A 4/1981 Davidson
4,689,090 A 8/1987 Sawtell et al.
4,874,440 A 10/1989 Sawtell et al.
5,055,257 A 10/1991 Chakrabarti et al.
5,059,390 A * 10/1991 Burleigh et al. ..... 420/405
5,293,708 A * 3/1994 Strayer et al. ..... 42/71.02
5,597,529 A 1/1997 Tack
5,620,652 A 4/1997 Tack et al.
5,624,632 A 4/1997 Baumann et al.
5,882,449 A * 3/1999 Waldron et al.

* cited by examiner

*Primary Examiner*—Stephen M. Johnson
(74) *Attorney, Agent, or Firm*—McCormick, Paulding & Huber LLP

(57) ABSTRACT

Firearms having scandium containing aluminum alloy components having alloying elements including light weight metals, such as magnesium, chromium, copper and zinc, heavier metals, such as zirconium, and other rare earth metals. The components have yield strengths of 82 to 100 KSI, tensile strengths of 88 to 106 KSI, 12 to 19% elongation's, and 7 to 10% reduction areas, and a method for heat treating the scandium containing aluminum alloy. The alloy is composed of 0.05% to 0.15% scandium, 7.5% to 8.3% zinc, 1.6% to 2.2% magnesium, 1.6% to 2.0% copper, 0.02% to 0.04% chromium, 0.05% to 0.15% zirconium, and 87 to 90% aluminum. A method for making the components involves exposure to solution heat treatment of 875° F. for an hours or two, followed by water quench, natural aging at ambient temperature for 24 to 72 hours, artificial aging at 250° F. for 24 hours, and allowed to air cool.

3 Claims, 4 Drawing Sheets

SCANDIUM CONTAINING ALUMINUM ALLOY FIREARM

CROSS REFERENCE TO RELATED APPLICATIONS

This application claims the benefit of U.S. Provisional Application Serial No. 60/205,270, filed on May 18, 2000, now abandoned, and is a Divisional Application of U.S. Utility application Ser. No. 09/859,983, filed on May 17, 2001, now U.S. Pat. No. 6,557,289, each of which are hereby incorporated in their entirety.

FIELD OF THE INVENTION

The present invention relates generally to firearms. More specifically, the present invention relates to firearms having components, such as frames and cylinders, made of scandium containing aluminum alloys, which alloys include alloying elements composed of 0.05% to 0.30% scandium and may include light weight alloying metals such as magnesium, chromium, copper and zinc, and additional rare earth elements such as zirconium, and to a method for heat treating the scandium containing aluminum alloy firearm components.

BACKGROUND OF THE INVENTION

Firearm frames composed of aluminum alloys have been known for some time. The life of such firearms is limited because conventional aluminum alloys breakdown relatively fast when compared to heavier materials such as steel. Furthermore, firearms composed of heavier materials are relatively heavy. Heavier firearms are inconvenient to carry concealed.

Revolver cylinders have not been manufactured using aluminum alloys because aluminum alloys of the prior art lack the strength and endurance to hold up under the stresses caused when the revolvers are discharged. Aluminum cylinders are subject to excessive wear and/or damage upon discharge of the revolvers making the cylinders inoperable. The damage sustained includes pitting and deformation of the cylinders under the high impact upon discharge of the revolver. Cylinders have been made of heavier materials such as steel and titanium alloys; however, revolvers having conventional steel cylinders are quite heavy, and titanium alloys are very expensive.

Firearms include many components in addition to a frame and a cylinder. Such components include, but are not limited to, barrel, slide, yoke, ejector, ejector rod, sear, hammer, and trigger. These parts are typically made of heavier metals which aggregate weight, including the frame and cylinder, if present, results in an overall heavier firearm than would result if lighter alloys were used in place of the heavier metals for as many parts as possible. Each component composed of heavy alloys, such as steel and titanium, increases the overall weight of the firearm in comparison to a firearm having lighter metal components. Components requiring high durability, endurance and strength have not been made of aluminum alloys. Many such components must function with minimum degradation under high impact and radical temperature change conditions. Such conditions occur repeatedly upon discharge of the firearm. Components of the firearm must be able to withstand the abuse inflicted thereupon, and prior art aluminum alloys have been unable to meet this requirement for a large number of firearm components.

Scandium is one of the most potent alloying elements in the periodic table. When added to an aluminum alloy, scandium significantly increases strength, and reduces grain size. Furthermore, scandium is a very light metal with a much higher melting point (2806.00° F.) than aluminum (1220.58° F.) making such alloys more durable in that they have longer life spans, have higher strength, and are degraded less by temperature extremes. In other words, aluminum-scandium alloys can sustain a larger range of repeated abuses including more extreme temperature variations than conventional aluminum alloys. Scandium containing aluminum alloys have improved strength, improved resistance to hot cracking, and improved resistance to recrystallization. Scandium provides the highest increment of strengthening per atomic percent of any alloying element when added to aluminum. Likewise, scandium containing aluminum alloys have dramatically greater thermal stability than aluminum alloys lacking scandium. Scandium containing aluminum alloys have been used in the manufacturing of baseball bats, bicycle frames, golf clubs, various exercise equipment and aerospace applications.

Scandium containing aluminum alloys and their products are well known in the art. Aluminum and aluminum alloys of varying binary, ternary and multicomponent types having from 0.01 to about 5.0 percent by weight of scandium, which may also contain copper, magnesium, zinc, manganese, beryllium, lithium, iron, silicon, nickel, chromium, titanium, vanadium, zirconium, boron, bismuth and lead, are described in U.S. Pat. No. 3,619,181, assigned to Aluminum Company of America. U.S. Pat. No. 4,261,767, assigned to Creusot-Loire of Paris, discloses an alloy resistant to high temperature oxidation which includes chromium, nickel, iron, aluminum and at least one rare earth metal. Similarly, U.S. Pat. No. 5,059,390, assigned to Aluminum Company of America, discloses a dual-phase magnesium-based alloy consisting essentially of lithium, aluminum, a rare earth metal (preferably scandium), zinc and manganese. U.S. Pat. No. 4,261,742, assigned to Johnson, Matthey & Co., Limited, describes platinum group metalcontaining superalloys which may include 0.01 wt % to 3 wt % scandium plus chromium, aluminum, titanium, one or more of the platinum group metals, and nickel. Furthermore, U.S. Pat. No. 4,689,090, also assigned to Aluminum Company of America, describes superplastic aluminum alloys containing scandium.

Products composed of scandium containing aluminum alloys are well known in the prior art as mentioned briefly hereinabove. U.S. Pat. No. 5,597,529, assigned to Ashurst Technology Corporation (Ireland) Limited, discloses aluminum-scandium alloys which may be used in welding applications and bicycle components. U.S. Pat. No. 5,620,652, also assigned to Ashurst Technology Corporation (Ireland) Limited, discloses aluminum alloys containing scandium with zirconium additions which may be used in recreational, athletic structures and components thereof, and in certain aerospace, ground transportation, marine structures and components thereof. Neither of these applications disclose the use of scandium containing aluminum alloy firearms. The recreational equipment disclosed are made from sheets of metal instead of being extrusion molded or pressed from metal bars.

U.S. Pat. No. 5,624,632, assigned to Aluminum Company of America, shows an aluminum alloy product for use as a damage tolerant product for aerospace applications, including fuselage skin stock, which alloy may include scandium. U.S. Pat. Nos. 5,055,257 and 4,874,440, also assigned to Aluminum Company of America, describe superplastic aluminum products and alloys containing scandium. U.S. Pat. No. 5,882,449, assigned to McDonnell Douglas Corporation, discloses a process for preparing aluminum-lithium-scandium rolled sheet products. These patents do not describe lightweight firearms composed of scandium containing aluminum alloys.

None of the above inventions and patents, taken either singularly or in combination, is seen to describe the instant invention as claimed. Thus, a scandium containing aluminum alloy firearm solving the aforementioned problems is desired.

SUMMARY OF THE INVENTION

The present invention relates to firearms having components made of scandium containing aluminum alloys which are composed of an aluminum alloy containing alloying elements which include, in addition to aluminum, from about 0.05% to about 0.30% scandium plus light weight metals such as magnesium, chromium, copper, and zinc. The scandium containing aluminum alloy may also have zirconium as an alloying element, and may contain additional heavier metals and other rare earth metals. Preferably, the scandium containing aluminum alloy is composed of from about 0.05% to about 0.15% scandium, from about 7.5% to about 8.3% zinc, from about 1.6% to about 2.2% magnesium, from about 1.6% to about 2.0% copper, from about 0.02% to about 0.04% chromium, and from about 0.05% to about 0.15% zirconium with the balance being composed of aluminum. Incidental elements, impurities and other grain refiners may be present in the alloy as is well known in the art of metallurgy.

The scandium containing aluminum alloys used in the present invention have the following properties: yield strengths of 82 KSI to 100 KSI, tensile strengths of 88 KSI to 106 KSI, 12% to 19% elongation's, and 7% to 10% reduction areas. Embodiments of the present invention include, but are not limited to, revolvers having scandium containing aluminum alloy frames and/or cylinders, and pistols having scandium containing aluminum alloy frames and/or slides. Further embodiments of the present invention include revolvers, pistols, air guns, gas guns, nail guns and rifles having scandium containing aluminum alloy components, which components include frames.

The present invention also contemplates a method of heat treating the scandium containing aluminum alloy firearm components to create components having the desired properties. The heat treatment follows forging or machining from bar stock. The forged components are exposed to solution heat treatment at about 875° F. for one to two hours, followed by rapid water quench, then the components are naturally aged at ambient temperature for 24 to 72 hours (typically about 48 hours), followed by artificial aging at 250° F. for about 24 hours, and finally allowed to air cool. The resulting components have the highly desired properties indicated. The scandium containing aluminum alloy components, plus any conventional components, are then assembled to make surprisingly lightweight but durable firearms.

An advantage of the present invention is to provide a firearm which is lightweight yet has higher yield and tensile strengths than conventional aluminum alloy firearms. In particular, revolvers having both scandium containing aluminum alloy cylinders and scandium containing aluminum alloy frames are very lightweight. Furthermore, pistols having scandium containing aluminum alloy frames and/or slides are substantially lighter than prior art pistols. Lightweight revolvers and pistols are desirable as they allow law enforcement officers to easily carry a lightweight second firearm.

It is a further advantage of the invention to provide a frame for a firearm which is lightweight yet sturdy and durable enough for use in law enforcement. Scandium containing aluminum alloy firearms are stronger and more durable than their aluminum alloy counterparts. Having strong lightweight rifles, revolvers and pistols which law enforcement officials can carry easily is desirable.

Another advantage of the invention is to provide a lightweight yet very strong cylinder which can be used with the frame of the present invention to produce an extraordinarily lightweight revolver. High caliber revolvers, such as .32 and .38 caliber, can be made with scandium containing aluminum alloy cylinders and frames thereby producing extremely lightweight yet sturdy revolvers.

Yet another advantage of the present invention is to provide lightweight firearms having increased life comparable to heavier metal alloys such as steel and titanium. Conventional aluminum alloy firearms have limited life spans compared to firearms composed of heavier metal alloys. Furthermore, firearms, such as airguns and gas guns, having increased life spans and lightweight construction are also desirable.

These and other advantages of the present invention will become readily apparent upon further review of the following specification and drawings.

BRIEF DESCRIPTION OF THE DRAWINGS

The novel features of the described embodiments are specifically set forth in the appended claims; however, aspects relating to the structure of certain embodiments of the present invention, may best be understood with reference to the following description and accompanying drawings.

Similar reference characters denote corresponding features consistently throughout the attached drawings.

DETAILED DESCRIPTION OF PREFERRED EMBODIMENTS

The term "light weight metal" as used herein shall mean any metallic element or alloy thereof having a relatively low density; this term shall expressly include aluminum as well as chromium, copper, magnesium, and zinc. Also, the term "rare earth metal" shall expressly include scandium, yttrium and the lanthanoids, and specifically includes oxides of the rare earth metals. The term "firearm" as used herein is defined to include apparatuses capable of firing a projectile using gas expansion and air pressure as a propellant in addition to the more conventional use of an explosive as a propellant. The term firearm shall include air pump, nail and gas expansion guns as well as conventional pistols, revolvers, rifles and the like.

As used herein, all percentages (%) are percent weight to weight, also expressed as weight/weight %, %(w/w), w/w, w/w % or simply %, unless otherwise indicated.

Figure 1:
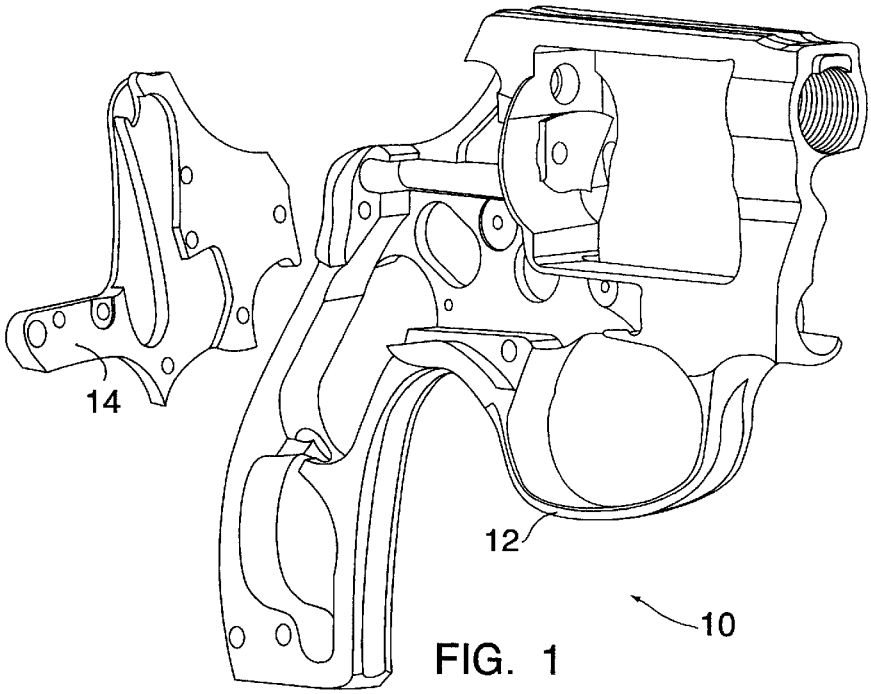
FIG. 1 is a schematic illustration showing a perspective view of a revolver frame.

One embodiment of the present invention is a revolver having a frame 10, as shown in FIG. 1 with two frame parts 12 and 14. The frame is typically made of a scandium containing aluminum alloys of light weight metals plus zirconium in which the scandium containing aluminum alloy has a yield strength of about 82 KSI to about 100 KSI, a tensile strength of about 88 KSI to about 106 KSI, about 12% to about 19% elongation, and about 7% to about 10% reduction area. Most preferably, the yield strength is from about 95 KSI to about 99.5 KSI, the tensile strength is about 100 KSI to 105 KSI, about 13% elongation, and about 7% reduction area. The scandium content may range from about 0.05% to about 0.30%, preferably from about 0.05% to about 0.15%, and most preferably about 0.1%.

Figure 2:
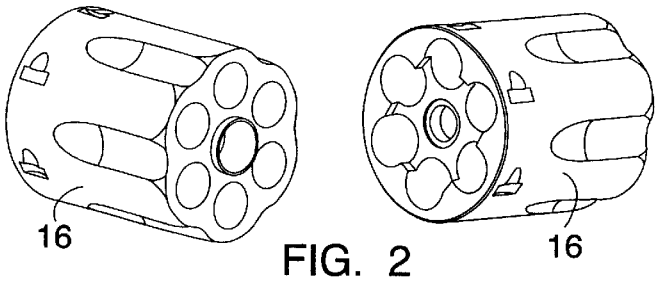
FIG. 2 is a schematic illustration showing a perspective view of a revolver cylinder.
Figure 3:
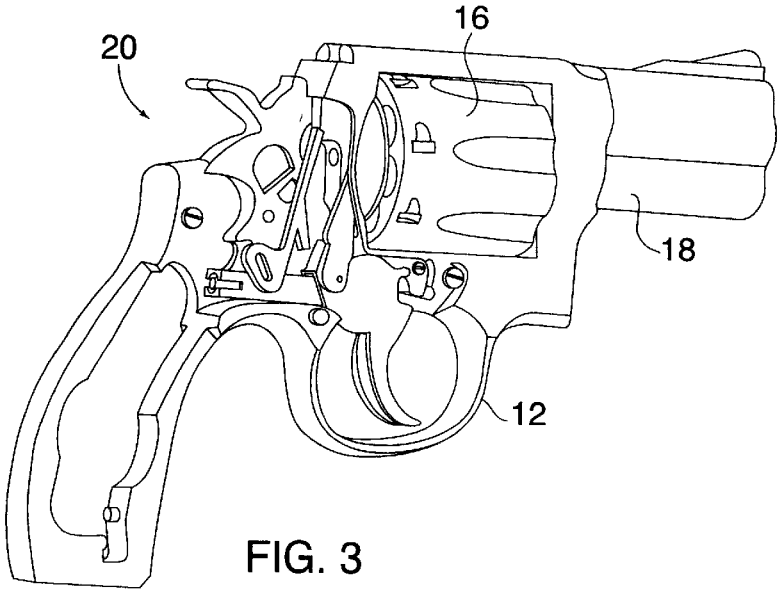
FIG. 3 is a schematic illustration showing a perspective view of a revolver frame with a cylinder and barrel attached thereto.

Another embodiment of the present invention is a revolver 20 having a scandium containing aluminum alloy frame 10, as in the prior embodiment, and a cylinder 16, shown in FIG. 2, made of a scandium containing aluminum alloy of predominantly light weight metals, scandium and zirconium wherein the alloy has a yield strength of about 82 KSI to about 100 KSI, a tensile strength of about 88 KSI to about 106 KSI, about 12% to about 19% elongation, and about 7% to about 10% reduction area. Most preferably, the yield strength is from about 95 KSI to about 99.5 KSI, the tensile strength is about 100 KSI to 105 KSI, the percent elongation is about 13%, and the percent reduction area is about 7%. The scandium content may range from about 0.05% to about 0.30%, preferably from about 0.05% to about 0.15%, and most preferably about 0.1%. FIG. 3 depicts the cylinder 16, engaged in the frame part 12 with the barrel 18 attached thereto. An example of a revolver is shown in U.S. Pat. No. 4,934,081, assigned to Smith and Wesson Corporation and incorporated herein by reference. Another example is U.S. Application Serial No. 09/834,004, entitled "Revolver Safety Lock Mechanism", filed on Apr. 12, 2001, assigned to the same assignee, Smith and Wesson Corporation, and is incorporated herein by reference.

Figure 4:
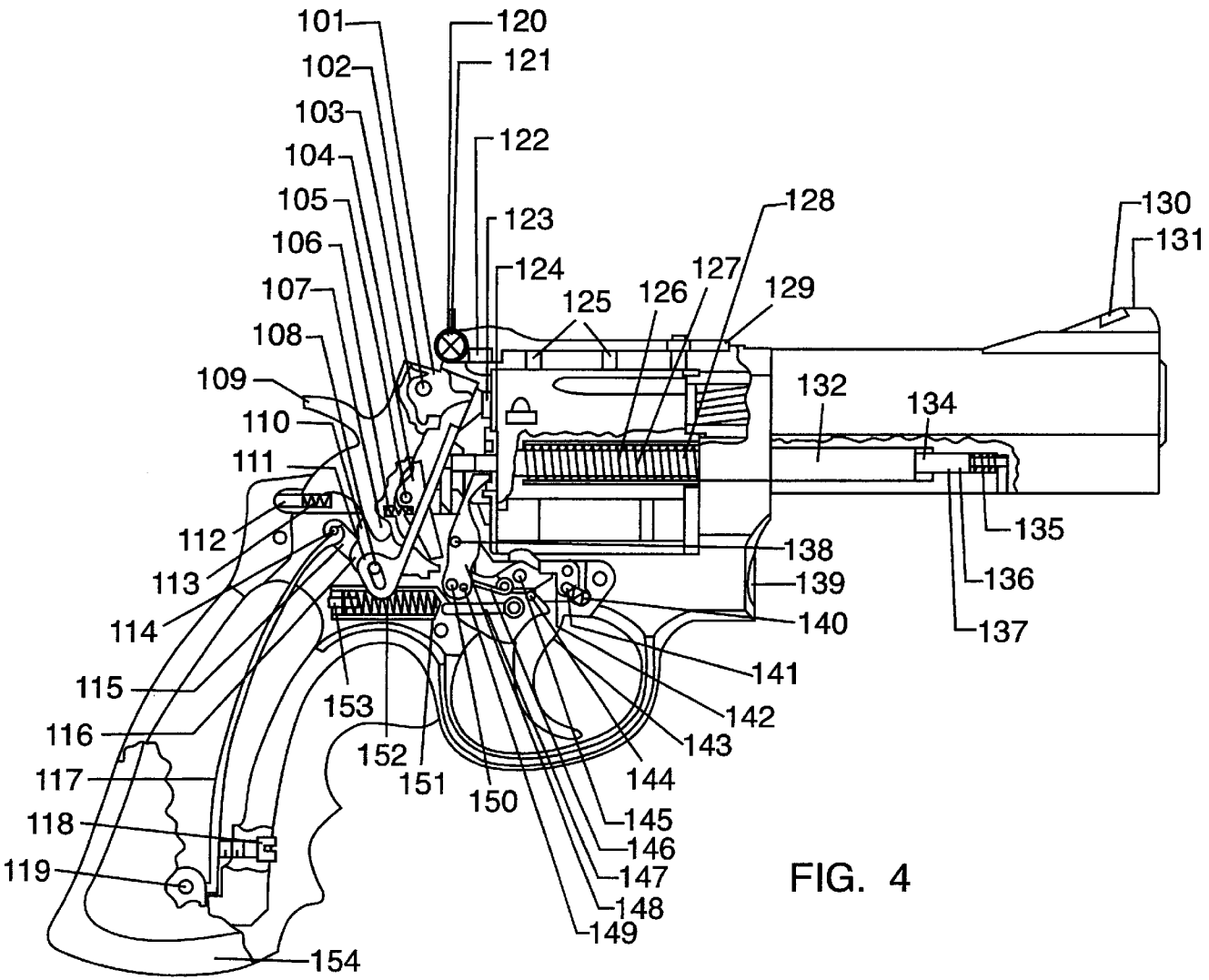
FIG. 4 is a schematic cutaway illustration depicting components of a revolver.

FIG. 4 is a schematic cutaway illustration depicting components of a revolver. Many of these components are made of conventional heavier metal alloys. The overall weight of the revolver may be reduced dramatically by fabricating as many components as possible from the scandium containing aluminum alloy of the present invention. Components and other aspects of a revolver are shown in FIG. 4, and are as follows: hammer nose 101, hammer nose rivet 102, hammer nose spring 103, sear 104, sear pin 105, sear spring 106, hammer stud 107, rebound slide pin 108, hammer 109, bolt 110, hammer block 111, bolt plunger 112, bolt plunger spring 113, stirrup stud 114, stirrup 115, stirrup pin 116, mainspring 117, strain screw 118, stock pin 119, rear sight slide 120, rear sight windage screw 121, rear sight elevation screw 122, hammer nose bushing 123, extractor 124, scope mount holes 125, center pin spring 126, extractor spring 127, extractor rod collar 128, rear site leaf 129, red insert 130, front sight 131, extractor rod 132, center pin 134, locking bolt spring 135, locking bolt pin 136, locking bolt 137, bolt stop pin 138, yoke 139, cylinder stop spring 140, cylinder stop stud 141, cylinder stop 142, trigger 143, hand torsion spring pin 144, trigger stud 145, hand torsion spring 146, trigger stud 145, hand torsion spring 146, trigger lever 147, hand 148, hand pin 149, hand stud 150, rebound slide 151, rebound slide spring 152, rebound slide stud 153, and grip 154.

Figure 5:
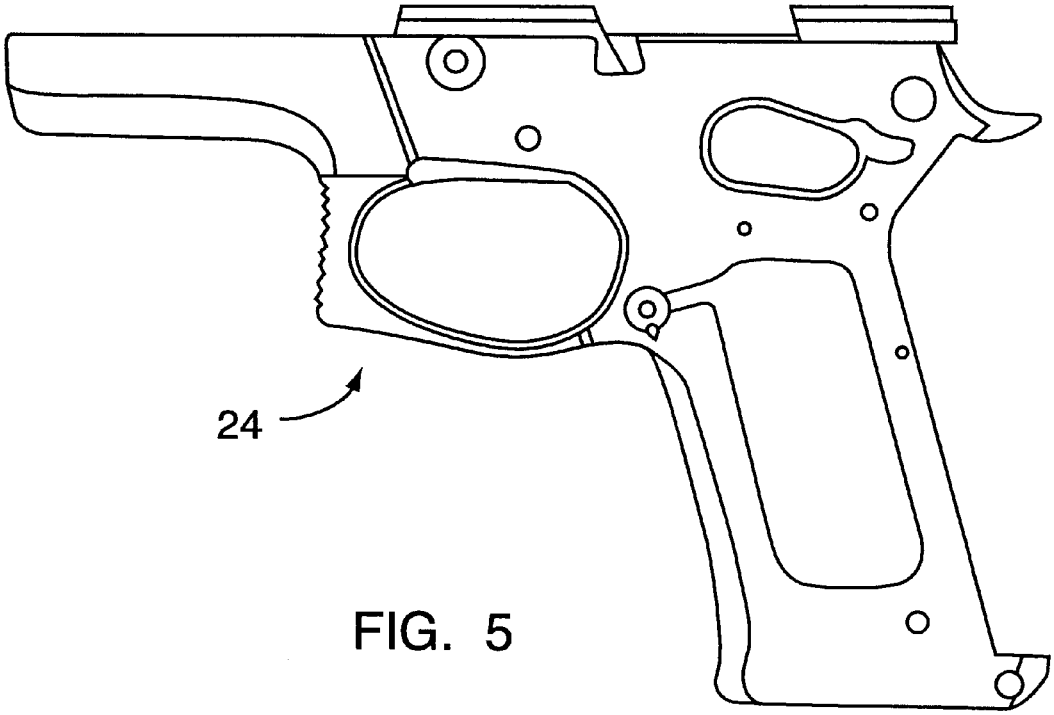
FIG. 5 is a schematic illustration showing a side view of a pistol frame.

Yet another embodiment of the present invention is a pistol having a scandium containing aluminum alloy frame 24, as shown in FIG. 5. The frame 24 is composed of a scandium containing aluminum alloy of predominantly light weight metals, scandium and zirconium wherein the alloy has a yield strength of about 82 KSI to about 100 KSI, a tensile strength of about 88 KSI to about 106 KSI, about 12% to about 19% elongation, and about 7% to about 10% reduction area. Most preferably, the yield strength is from about 95 KSI to about 99.5 KSI, the tensile strength is about 100 KSI to 105 KSI, about 13% elongation, and about 7% reduction area. An example of a pistol is shown in U.S. Pat. No. 5,797,206 also assigned to Smith and Wesson Corporation and incorporated herein by reference.

Figure 6:
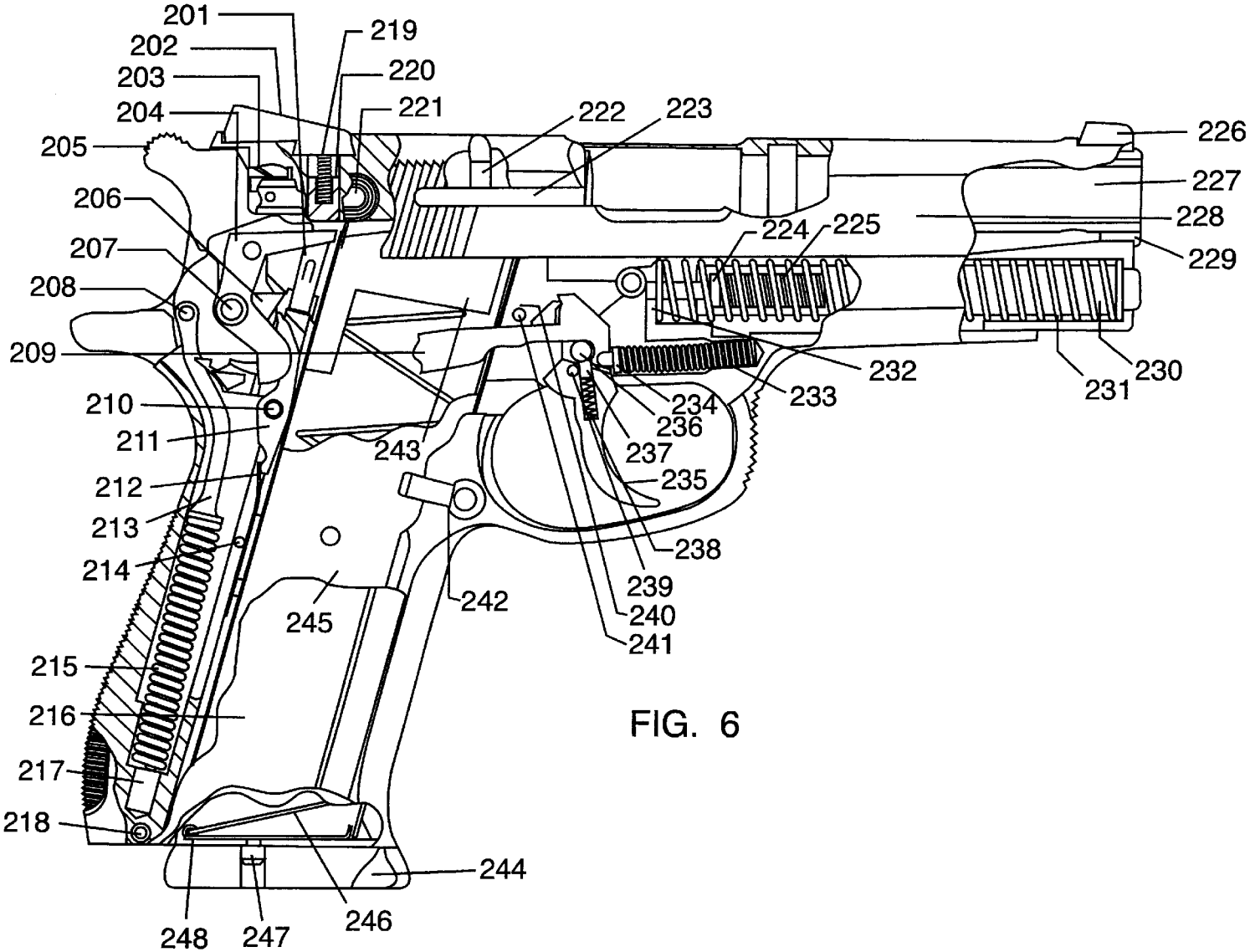
FIG. 6 is a schematic cutaway illustration depicting components of a pistol.

FIG. 6 is a schematic cutaway illustration depicting components of a pistol. Many of these components are made of conventional heavier metal alloys. The overall weight of the pistol may be reduced dramatically by fabricating as many components as possible from the scandium containing aluminum alloy of the present invention. Components and other aspects of a pistol are shown in FIG. 6, and are as follows: disconnector 201, carry rear sight 202, manual safety 203 (fire position), firing pin safety lever 204, hammer 205, sear release lever 206, hammer pin 207, stirrup pin 208, drawbar 209, sear pin 210, sear 211, sear spring 212, stirrup 213, rear spring retaining pin 214, mainspring 215, grip 216, mainspring plunger 217, grip pin 218, safety lever plunger spring 219, firing pin safety plunger 220, ambidextrous manual safety lever 221, extractor pin 222, extractor 223, recoil spring guide plunger 224, recoil spring guide plunger spring 225, front site 226, barrel 227, slide 228, barrel bushing 229, recoil spring guide rod 230, recoil spring 231, recoil spring guide bushing 232, drawbar plunger spring 233, drawbar plunger 234, trigger 235, trigger pin 236, trigger plunger 237, trigger plunger spring 238, trigger plunger pin 239, trigger play spring 240, trigger play spring rivet 241, magazine catch 242, magazine follower 243, magazine butt plate 244, magazine tube 245, magazine spring 246, magazine butt plate rivet 247,and magazine butt plate catch 248.

The lightweight metals are taken from the group consisting of aluminum, chromium, copper, magnesium, zinc, and combinations thereof. Heavier metals, such as zirconium, may also be constituents of the alloy. Additionally, other rare earth metals may be present in the alloy. Furthermore, grain refiners, and other incidental elements and impurities may be present as is well understood in the art of metallurgy.

Preferably, the scandium containing aluminum alloy may have the following contents: zinc (7.5% to 8.3%), magnesium (1.6% to 2.2%), copper (1.6% to 2.0%), chromium (0.02% to 0.04%), scandium (0.05% to 0.15%), zirconium (0.05% to 0.15%), and aluminum (87% to 90%). Most preferably the scandium content is about 0.1% but may range anywhere from about 0.05% to about 0.30%. It is understood that other constituents may be present. It is desirable that the physical properties meet the minimum tensile strength of 85 KSI after forging and heat treatment.

Scandium containing aluminum alloys for use in the present invention may be purchased from Tri-Kor Alloys, LLC. Other suppliers of suitable scandium containing aluminum alloys include, but are not limited to, Arris International, Alyn Corporation, Ashurst Technology Corporation (Ireland) Limited, and Aluminum Company of America. Cast and extruded bar stock are desirable initial alloy forms. The physical properties of the scandium containing aluminum alloy are the primary consideration of which alloy is utilized.

The process used to make the present invention is similar to the process used to make conventional aluminum firearms. However, the heat treatment is unique. The frame is extruded, forged or pressed first then heat-treated. The scandium containing aluminum alloy composition for the cylinder is heat treated prior to being extruded forged or pressed. Round bar stock 2' by 2" are preferably drop forged in a mechanical press, or extruded into a mold, to form the frames of the present invention. Cylinders are machined from round bar stock. The frames are milled afterwards to cut away the extra metal along the edges to make the final shape before heat treatment. Other components are formed as necessary using any of the above procedures before heat treatment.

The heat treatment process requires care for appropriate hardness, and is desirable for alloys used in conventional explosive propelled firearms. FIG. 7 depicts a flow chart 50 of the method for heat treating the scandium containing aluminum alloy components of the present invention. Initially, the firearm components are fabricated out of the scandium containing aluminum alloy as described hereinabove then they are heat-treated. The scandium containing aluminum alloy components are exposed to about 875±5° F. for a minimum of one hour and a maximum of about two hours, as denoted by the numeral 52 in the flow chart 50. The scandium containing aluminum alloy components are then water quenched 54, and naturally aged 55 for a minimum of about 24 hours, most preferably about 72 hours. The scandium containing aluminum alloy components are then aged artificially 56 at about 250±5° F. for about 24 hours. The components are then allowed to cool 57 to room temperature. The preferred method of heat treating the scandium containing aluminum alloy components, for the firearms of the present invention, comprises the steps of heating scandium containing aluminum alloy components to about 875±5° F. degrees for one to two hours, quenching the scandium containing aluminum alloy components in water, aging the scandium containing alloy components at room temperature for about 72 hours, and then aging the scandium containing aluminum alloy components artificially at about 250±5° .F for about 24 hours. Proper heat treatment results in the physical properties indicated.

An example of the heat treatment utilized in producing frames for scandium containing aluminum alloys is as follows. The type of heat treatment used involves solution treating and precipitation hardening of the scandium containing aluminum alloy revolver frames. The equipment used was a conventional tempering furnace, 22" to 34" Ipsen basket liners surveyed to ±5° F. at nine locations, and a portable water quench tank. The heat treatment involved the following processes. The revolver frames were stacked vertically, trigger guard down with 21 pieces per row, six rows per basket, 126 pieces per tray high, and 252 frames per load maximum. Five crossbars to support the weights of the upper basket. The furnace was preconditioned at 875±5° F. The load of revolvers were solution treated for sixty minutes minimum at heat 875±5° F. Subsequently, the load was water quenched and the hardness of the first load in each shift was checked. The load was then delay aged for 72 hours at the minimum, and then precipitation hardened at 250±5° F. for 24 hours minimum. Finally, the load was air cooled to room temperature.

Test bar results for forged and heat treated samples were determined. Two dog bone test bars were forged from scandium containing aluminum alloys used in the present invention. The test bars were drop forged in a mechanical press. Two bars were pulled apart by a testing machine which grips both ends of the bone shaped test bars and applied measured force to pull each end of the bars tested apart. The first bar pulled had a tensile strength of 88.6 KSI, a yield strength of 83.0 KSI, and an elongation of 16%. The second bar pulled had a tensile strength of 89.0 KSI, a yield strength of 84.2 KSI, and an elongation of 18%.

Proof testing was conducted on completed revolvers having frames made of scandium containing aluminum alloys as contemplated by the present invention with titanium cylinders. The resulting revolvers were discharged with an overload of ammunition. Twenty proof rounds were conducted with no yield. The revolvers were also tested for fatigue by discharging 2500 to 5000 rounds and passed the test. One revolver had half the material cut away to produce a weaker revolver and tested. The weaker revolver withstood proof rounds as well and did not fail. Revolvers chambered in .38 caliber ammunition comprising cylinders and frames having the scandium containing aluminum alloys as contemplated by the present invention were also tested and did not fail.

It is to be understood that the present invention is not limited to the embodiments described above, but encompasses any and all embodiments within the scope of the following claims.

What is claimed is:

1. A method of heat treating scandium containing aluminum alloy components for firearms comprising the steps of:

i) heating the scandium containing aluminum alloy components at about 875±5° F. for one to two hours;

ii) quenching the scandium containing aluminum alloy components in water;

iii) aging the scandium containing aluminum alloy components at room temperature for about 72 hours; and iv) aging the scandium containing aluminum alloy components artificially at about 250±5° F. for about 24 hours.

2. The method of claim 1 further comprising the step of:

v) cooling the scandium containing aluminum alloy components to room temperature.

3. The method of claim 1 wherein the components are taken from the group consisting of revolver frames, revolver cylinders, pistol frames, and rifle frames.

* * * * *